US005156826A

United States Patent [19]

Müller et al.

[11] Patent Number: 5,156,826

[45] Date of Patent: Oct. 20, 1992

[54] METHOD AND APPARATUS FOR THE ELIMINATION OF ODOROUS SUBSTANCES IN GASES BY HEATING IN A COMBUSTION PLANT

[75] Inventors: Klaus Müller, Kreuzwertheim; Roland Meyer-Pittroff, Eckental, both of Fed. Rep. of Germany

[73] Assignee: Anton Steinecker Maschinenfabrik GmbH, Freising, Fed. Rep. of Germany

[21] Appl. No.: 713,583

[22] Filed: Jun. 11, 1991

Related U.S. Application Data

[63] Continuation of Ser. No. 340,043, Apr. 18, 1989, abandoned.

[30] Foreign Application Priority Data

Apr. 19, 1988 [DE] Fed. Rep. of Germany ..... 3813092

[51] Int. Cl.[5] ..... B01D 53/34

[52] U.S. Cl. ..... 423/245.3

[58] Field of Search ..... 423/245.3; 422/4.5; 110/210, 212; 99/277, 277.1, 323.1

[56] References Cited

U.S. PATENT DOCUMENTS

| | | | |
|---|---|---|---|
| 2,795,054 | 6/1957 | Bower, III | 423/245.3 |
| 3,164,445 | 1/1965 | Hampel | 422/173 |
| 3,285,157 | 11/1966 | Smith, Jr. | 99/476 |
| 3,328,894 | 7/1967 | Smith, Jr. | 34/57 A |
| 3,345,181 | 10/1967 | Smith, Jr. | 426/314 |
| 3,468,634 | 9/1969 | Pauletta | 422/170 |

FOREIGN PATENT DOCUMENTS

| | | |
|---|---|---|
| 272818 | 7/1969 | Austria . |
| 0058892 | 2/1982 | European Pat. Off. . |
| 2207803 | 8/1973 | Fed. Rep. of Germany . |
| 2354780 | 5/1975 | Fed. Rep. of Germany . |
| 2452418 | 8/1975 | Fed. Rep. of Germany . |
| 2524151 | 12/1976 | Fed. Rep. of Germany . |
| 2615552 | 10/1977 | Fed. Rep. of Germany . |
| 2912304 | 10/1979 | Fed. Rep. of Germany . |
| 3152089 | 8/1982 | Fed. Rep. of Germany . |
| 3738790 | 6/1988 | Fed. Rep. of Germany . |
| 1244198 | 8/1971 | United Kingdom . |

OTHER PUBLICATIONS

Abstract of German Offenlegungsschrift 2,452,418.

Lauer et al, *Chemical Engineering Techniques*, Reinhold Publishing Corp. 1952, pp. 220–222.

*Industrial Pollution Control Handbook*, Lund, ed. McGraw-Hill Book Co. 1971, pp. 5–27 to 28; 7–8 to 11.

Olsen, *Unit Processes And Principlels Of Chemical Engineering*, D. Van Nostrand Co. Inc. 1932, pp. 1–3.

Kloth (1955), pp. 1182–1185, (no translation).

Kennzifer (1984), (no translation).

Pütz (1983), (no translation).

"A New Continuous Cocoa Bean Roasting Plant" *Food* (1954).

*Primary Examiner*—Jeffrey E. Russel

*Attorney, Agent, or Firm*—Seed and Berry

[57] ABSTRACT

The invention relates to a method and apparatus for the elimination of odoriferous substances in gases or vapors produced by processes for the treatment of organic materials, for instance foodstuffs or luxury foods, in a processing plant. For the elimination of these odoriferous substances the invention proposes that the gases or vapors are supplied to a furnace installation of the processing plant and subjected therein to temperatures of at least 400° C., the heat generated by the furnace installation being directly or indirectly, and at least in part, used for the respective treatment process. According to the invention, an apparatus for performing the method is characterized in that a gas or vapor discharge duct of a vessel used or heating, boiling, roasting, deep-frying, cooking and/or melting of the materials to be processed is connected to the furnace installation by a gas flow duct.

2 Claims, 1 Drawing Sheet

METHOD AND APPARATUS FOR THE ELIMINATION OF ODOROUS SUBSTANCES IN GASES BY HEATING IN A COMBUSTION PLANT

CROSS-REFERENCE TO RELATED APPLICATION

This application is a continuation of U.S. application Ser. No. 07/340,043, filed Apr. 18, 1989, now abandoned.

DESCRIPTION

The invention relates to a method and apparatus for the elimination of odoriferous substances in gases or vapors produced in a process for the treatment of organic substances such as foodstuffs or luxury foods in a processing plant.

In recent times increasing attention has been directed to the avoidance of air pollution of any kind, and particularly also to the reduction of molestation by odorous emissions of industrial installations.

In the industrial processing of, for instance, foodstuffs and luxury foods, various treatment processes are accompanied by the production of gases or vapors containing highly odoriferous substances. These substances are usually organic compositions such as alcohols, aldehydes, ketones, esters and the like.

A typical example in this regard are vapors produced in the brewing industry in the preparation of mash and the wort boiling operation. Other examples are odoriferous gases and vapors produced in treatment processes, for instance, in meat or fish processing plants, smoke-curing plants and malting plants, but also in other industries or installations, for instance and crematories.

In most cases, the odoriferous gases or vapors were hitherto discharged into the atmosphere without any particular treatment, resulting in odor molestation of the environment.

Known devices for the removal or elimination of odoriferous substances from gases or vapors include filters, gas scrubbers and recombustion installations.

In the brewery industry, the vapors escaping from the wort pan during the wort boiling process are in many cases used for the reclamation of heat by directing them through a pan vapor condenser in which the major part of the steam is condensed. Although this condensation results in a reduction of the emission of odoriferous substances, far more than half of the particularly odoriferous substances are entrained in the exhaust air, resulting in considerable molestation by noxious odors as generally known to anybody who has at any time stayed in the vicinity of a brewery plant.

In DE-OS 15 220, the present applicant has already proposed a method for the elimination of these odoriferous substances contained in the vapors, according to which the exhaust air containing these substances is scrubbed by the injection thereinto of a scrubbing water spray. The scrubbing water has to be treated with certain compositions for enabling it to eliminate the odoriferous substances. Gas scrubbing installations of this type are rather expensive as regards both their construction and their operation and maintenance, and have additionally to be adapted to any given field of use by the employment of corresponding additives.

Proceeding from this state of the art, it is an object of the present invention to provide a method of the type defined in the introduction, the performance of which permits odoriferous substances to be eliminated from vapors and the like in a particularly simple and effective manner. Another object of the invention is the provision of apparatus for performing this method.

In a method of the type defined in the introduction, the stated object is attained according to the invention by the provision that the gases or vapors containing the odoriferous substances are supplied to a furnace installation of the processing plant, wherein they are heated to temperatures of at least 400° C.

The method of the invention proceeds from the perception that organic odoriferous substances, for instance the type contained in wort boiling vapors, are decomposed at elevated temperatures, the decomposition products being mainly steam and carbon dioxide. When heated beyond their combustion temperature in the presence of atmospheric oxygen, the odoriferous substances are also substantially oxidized to again produce steam and carbon dioxide. The thus produced gases may then be discharged through the chimney together with the flue gases of the furnace installation without molestation by noxious odors in the vicinity.

Known in prior art are so-called recombustion installations, in which odoriferous gases or vapors are supplied to a special furnace installation for the sole purpose of subjecting the odoriferous substances to elevated temperatures for their decomposition or oxidation, this method resulting in considerable waste of energy when the heated gases are not substantially cooled in a heat exchanger for the reclamation of heat for use in the associated plant. For this reason, installations of this type have not met with universal acceptance, and are nowhere found in breweries for instance.

According to a method of the invention, the odoriferous gases or vapors are not fed to a special recombustion installation, but rather to a furnace installation included in the processing plant for supplying the required energy to the treatment process.

The recirculation of the gases or vapors to this furnace installation, therefore, usually does not involved any substantial loss of energy, because in the majority of practical applications the temperature of the gases or vapors entering the furnace installation will not be substantially lower than the exhaust gas temperature of the flue gases discharged into the chimney.

When the odoriferous gases or vapors contain oxygen and are supplied to the furnace installation together with the combustion air, the performance of the method according to the invention may even result in a gain of energy, since the warm or hot gases or vapors may be used in substitution of part of the combustion air otherwise supplied to the furnace installation at ambient temperature.

In a particularly advantageous embodiment of the method, the vapors produced in a brewery plant by the mash or wort boiling operation may be supplied to the furnace installation of the brewery to be heated therein. In view of the fact that the wort boiling house is the main heat consumer in a brewery, and has the required process heat supplied thereto from the furnace installation, it is ensured that the furnace installation is in full operation during the wort boiling process. Suitable control means may be provided for ensuring that the furnace installation is not shut down as long as the odoriferous substances escape from the mash or wort boiling pan, and that the vapors are thus heated. The odoriferous substances thus be completely eliminated in a particularly simple manner by heating the vapors in the furnace installation of the brewery.

The apparatus according to the invention for performing the method in a brewery plant equipped with a closed container 1 for the mash- and/or wort-boiling process, a vapor discharge duct 12 associated with the container 1, and a furnace installation 13 for supplying the required energy to the mash- or wort-boiling process, is characterized in that the vapor discharge duct is connected to the furnace installation through a gas flow duct 5, optionally including a fan 14 for conveyance of the gaseous flow. In its simplest embodiment for use in a brewery plant, the invention thus provides that the gas flow duct 5 leading to the furnace installation is branched off the vapor collecting hood 2 or the vapor discharge duct 12 associated with the mash or wort boiling pan in any case and optionally provided with an additional pan vapor condenser 3 installed therein.

The vapors are thus directed from the discharge duct to the furnace installation. The vapor discharge duct may of course be provided with a deflector valve 4 selectively operable to establish communication of the vapor discharge duct with the ambient atmosphere in one position, and with the pipeline leading to the furnace installation in another position.

The odoriferous gases or vapors may be introduced into the combustion chamber or the flue gas duct of the furnace installation at any suitable location, as long as it is ensured that the odoriferous gases or vapors, after mixing with the combustion air or flue gases of the furnace installation, will reliably attain a temperature of at least 400° C to thereby ensure the thermic decomposition of the odoriferous substances.

In the case of an industrial boiler installation of the conventional three-flue type, the most obvious location for the introduction of the gases or vapors is the rear flue gas return chamber between the flame tube and the first flue-gas pipe tract. Even in the case of existing installations, a pipe connector 15 for the introduction of the odoriferous gases or vapors can be readily installed at this location (by, for example, connection to a reversing chamber 17 of the boiler), whereat the flue gases are at a temperature in the range of about 700° C. to 900° C.

Another possibility for the introduction of the odoriferous gases or vapors into the furnace installation without excessively expensive structural modifications consists in mixing the gases or vapors with the combustion air.

When the furnace installation is a per se known gas- or oil-fired installation, the gases or vapors are supplied to the mixing chamber 6 of the burner together with the combustion air, and subsequently subjected to combustion in the combustion chamber. The conversion of already existing installations thus requires only the provision of a simple connection duct between the vapor discharge duct and the burner, to thereby produce a mixture of the combustion air and the gases or vapors upstream of the burner inlet, this mixture being subsequently supplied to the combustion chamber for the combustion of the respective fuel.

The energy produced by the furnace installation may of course be used for directly heating the mash- or wort-boiling pans, or indirectly by the intermediary of hot water or steam,

BRIEF DESCRIPTION OF THE DRAWING

The invention shall now be described in more detail with reference to the accompanying drawing, the only figure of which shows a diagrammatic illustration of an installation comprising an advantageous embodiment of the invention for explaining the operating principles of the invention.

Shown in the drawing is container 1, for instance a wort-boiling pan of a brewery plant. Container 1 is used in the known manner for boiling wort, or optionally a mash, with the aid of a heater installation 11. This boiling process results in the production of vapors containing strongly odoriferous substances. Disposed on top of container 1 is a vapor collecting hood 2 for the upward directed discharge of the vapors. The upward directed flow of the vapors may be directed through a pan vapor condenser 3 indicated by dotted lines. Disposed in a vapor discharge duct 12 is a hinged flap valve 4 adapted in the position shown to deflect the vapors containing the odoriferous substances towards the gas flow duct 5. When flap valve 4 is in its vertical position, the vapors are permitted to escape to the ambient atmosphere in the direction of arrow $P_U$. When on the other hand flap valve 4 assumes the position shown in the drawing, the vapors are deflected into the gas flow duct 5, as already explained, to be supplied to a furnace installation generally indicated at 13. In the embodiment shown, furnace installation 13 is a gas- or oil-fired installation comprising a mixing chamber 6 and a combustion chamber 7 having smoke tubes 16 provided therein, as illustrated in FIG. 1. The vapors containing the odoriferous substances $P_O$ and the combustion air $P_L$ required by the furnace installation are supplied to mixing chamber 6 to be mixed therein. The fuel $P_B$ is burned in combustion chamber 7 by a flame 8. The combustion temperature of flame 8 is usually above 1,000° C. The temperature of flame 8 results in the decomposition of the odoriferous substances consisting of organic compositions such as alcohols, aldehydes, ketones and esters, the products of this decomposition being mainly carbon dioxide and steam. The exhaust gases may then be discharged through a flue duct 9 without still containing any odoriferous substances. The energy produced by the combustion in combustion chamber 7 is supplied to heating installation 11 through a connecting pipe 10, and used for heating and boiling the medium in container 1. In this manner, it is possible to achieve not only the elimination of the odoriferous substances in the gas or vapor released by the heated medium, to thereby avoid the molestation of the environment by noxious odors, but also the at least partial reclamation of the heat contained in the gases or vapors.

Figure 1:
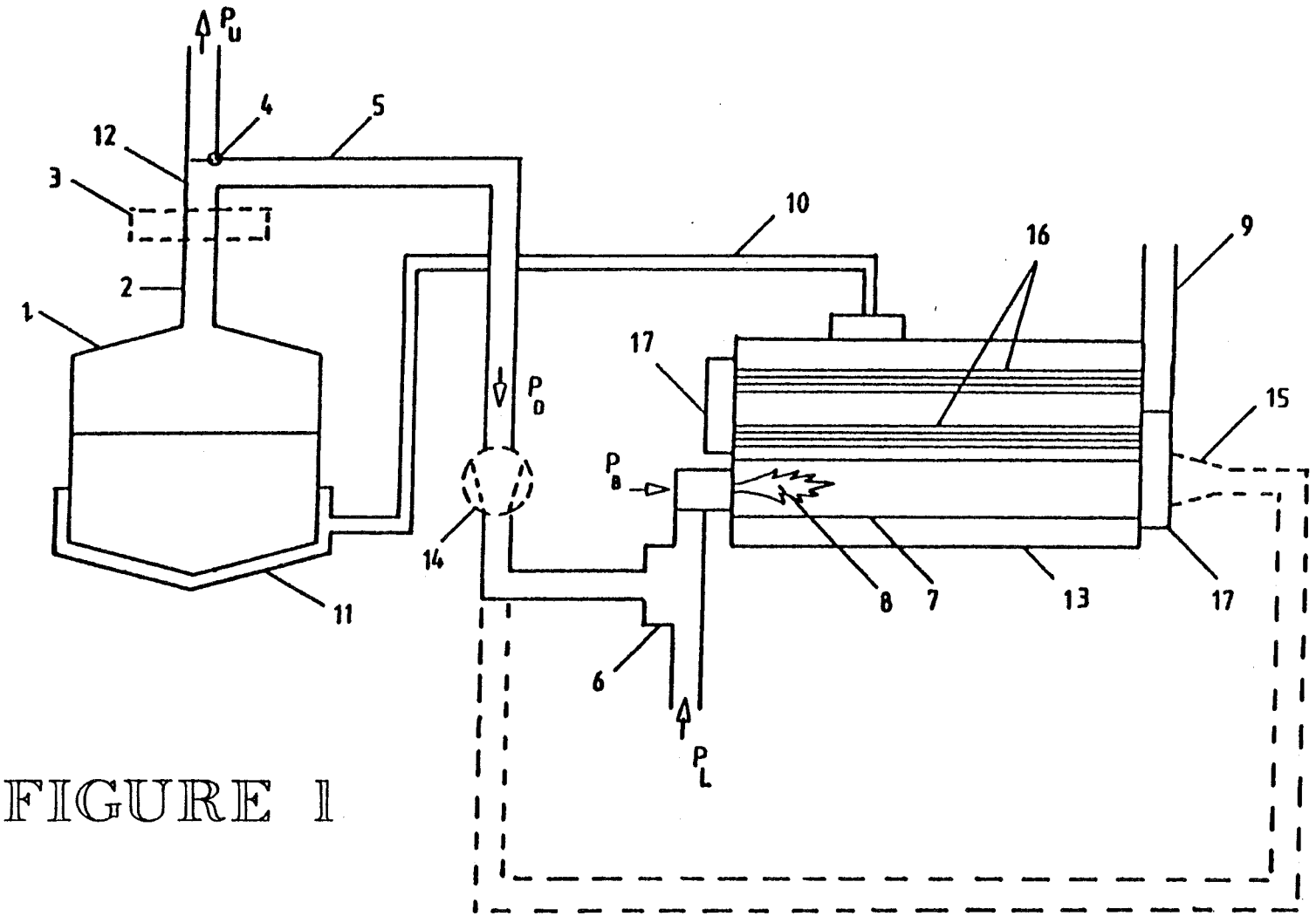

It is of course understood that this principle of the elimination of odoriferous substances is applicable not only to brewery boiling installations as illustrated, but also in the case of fish and meat processing plants, smoke-curing plants, roasting plants, deep-frying plants, canteens, fat melting plants and malting plants, as well as cellulose and paper mills, animal carcass processing plants, crematories and the like.

The described method and apparatus are particularly useful, however, for application in the brewing industry. The conversion of already existing installations can also be accomplished in a particularly simple manner by merely providing a suitable vapor or gas flow duct 5 between the vapor discharge duct 12 and a furnace installation 13. Likewise, the principle of the invention is of course not only applicable to gas- or oil-fired furnace installations, but also to any furnace installation operating with sufficiently high flame and flue gas temperatures for ensuring the decomposition of the odoriferous compositions.

We claim:

1. A method for eliminating odorous substances from the waste vapors produced in a brewery, comprising the following steps:

heating or boiling mash or wort in a closed container by applying heat thereto, said heat being supplied by a single furnace and resulting in said odorous substances being released from said mesh or wort in said waste vapors;

directing said waste vapors to said furnace, with the proviso that said waste vapors are not fed to a recombustion installation which is apart from said furnace supplying heat to said mash or wort; and heating said waste vapors in said furnace until said waste vapors obtain a temperature of at least 400° C., resulting in the decomposition of said waste vapors and the elimination of said odorous substances therefrom.

2. The method of claim 1 further comprising, prior to directing said waste vapors to said furnace, directing said waste vapors through a condenser.

* * * * *